US011399646B2

(12) United States Patent
Zadeh

(10) Patent No.: US 11,399,646 B2
(45) Date of Patent: Aug. 2, 2022

(54) MULTI-HINGED TRI-FOLDING GARMENT HANGER

(71) Applicant: P. Vincent Zadeh, West Hills, CA (US)

(72) Inventor: P. Vincent Zadeh, West Hills, CA (US)

( * ) Notice: Subject to any disclaimer, the term of this patent is extended or adjusted under 35 U.S.C. 154(b) by 184 days.

(21) Appl. No.: 16/578,428

(22) Filed: Sep. 23, 2019

(65) Prior Publication Data

US 2021/0085112 A1 Mar. 25, 2021

(51) Int. Cl.
*A47G 25/40* (2006.01)

(52) U.S. Cl.
CPC ..... *A47G 25/4038* (2013.01)

(58) Field of Classification Search
CPC . A47G 25/4038; A47G 25/40; A47G 25/4061
See application file for complete search history.

(56) References Cited

U.S. PATENT DOCUMENTS 1,836,942 A * 12/1931 Sumi ..... A47G 25/4038 223/94
1,951,985 A 3/1934 Likiy
2,425,527 A * 8/1947 Gaudino ..... A47G 25/4038 223/94
2,478,590 A * 8/1949 McKnelly ..... A47G 25/4061 D6/318
3,430,827 A 3/1969 Nelson
4,126,252 A 11/1978 Wasserman
4,168,791 A 9/1979 Clark, Jr.
4,300,688 A 11/1981 London et al.
4,669,642 A 6/1987 Nicholas
4,813,581 A 3/1989 LaMont
4,932,571 A 6/1990 Blanchard
4,997,115 A 3/1991 Jolley
5,085,357 A * 2/1992 Chen ..... A47G 25/4038 223/85

(Continued)

FOREIGN PATENT DOCUMENTS

WO 1998018371 A2 5/1998
WO 2003099082 A1 12/2003

(Continued)

*Primary Examiner* — Nathan E Durham
(74) *Attorney, Agent, or Firm* — Legalforce RAPC Worldwide

(57) ABSTRACT

A multi-hinged tri-folding garment hanger is disclosed. In one embodiment, a garment hanger includes a central frame embodying a first arm and a second arm toward each end configured to support corresponding shoulder portions of a garment in an open state of the garment hanger. In addition, the garment hanger includes four vertical members to connect the top elements to the corresponding bottom elements of the central frame. The central frame further includes a first double hinge joint on a top portion and a second double hinge joint on a bottom portion toward each of the first end and second end around which correspondingly the arms are capable of folding back onto the central frame toward a center thereof to a folded state. A hook member pivotably attached to the top portion of the central frame may be retractably folded to a most compact state without removal of the garment.

20 Claims, 8 Drawing Sheets

(56) References Cited

U.S. PATENT DOCUMENTS

| | | | | | |
|---|---|---|---|---|---|
| 5,590,823 | A | | 1/1997 | Lunde | |
| 5,632,422 | A | * | 5/1997 | Csengeri | A47G 25/4038 223/89 |
| 5,687,888 | A | * | 11/1997 | Chang | A47G 25/4038 223/85 |
| 5,690,257 | A | | 11/1997 | Ward | |
| 5,893,493 | A | | 4/1999 | Noiray | |
| 6,026,998 | A | | 2/2000 | Brooks | |
| 6,293,443 | B1 | | 9/2001 | Nykoluk | |
| 6,675,997 | B1 | | 1/2004 | Gouldson et al. | |
| D508,614 | S | * | 8/2005 | Colon | D6/318 |
| 7,172,102 | B2 | | 2/2007 | Lewien et al. | |
| 7,185,795 | B1 | | 3/2007 | Wallick | |
| 8,028,869 | B2 | | 10/2011 | Rossaki | |
| 8,523,026 | B2 | | 9/2013 | Tseng et al. | |
| 9,392,896 | B1 | | 7/2016 | Lieck, Jr. et al. | |
| D896,533 | S | * | 9/2020 | Zadeh | D6/319 |
| 2007/0194064 | A1 | | 8/2007 | Elder | |
| 2015/0150399 | A1 | | 6/2015 | Lee | |
| 2015/0230644 | A1 | | 8/2015 | Kallet | |
| 2016/0022076 | A1 | | 1/2016 | Yip et al. | |
| 2016/0157651 | A1 | | 8/2016 | Levin et al. | |

FOREIGN PATENT DOCUMENTS

| | | | |
|---|---|---|---|
| WO | 2012040010 | A1 | 3/2012 |
| WO | 2014025132 | A1 | 2/2014 |
| WO | 2016163564 | A1 | 10/2016 |
| WO | 2018230944 | A1 | 12/2018 |

* cited by examiner

MULTI-HINGED TRI-FOLDING GARMENT HANGER

FIELD OF TECHNOLOGY

A multi-hinged tri-folding garment hanger is disclosed. This disclosure relates generally to garment hanger, and, more particularly, to a method, a device and/or a system of a multi-hinged tri-folding garment hanger.

BACKGROUND

A garment may be packaged for shipment and/or storage in a folded form to help save the space while shipping the garment. The garment may be packaged and arranged in a folding garment fixture and/or frame (e.g., a hanger) to maintain its desired shape and wrinkle-free condition. In addition, the garment may need to be discernible for easy access when in a closet. This may be achieved when the garment is attached to a fixture through a garment retaining means (e.g., a hanger). It may be an inefficient utilization of space when the hanger is arranged inside of a suitcase (e.g., a portable carrier).

When traveling long distance, a traveller may need to carry the garment (e.g., a suit, a shirt, trousers, etc.) to attend a formal meeting (e.g., a trade fair, a business meeting, a conference, a presentation, etc.) and/or a social function. The hanger may be bulky, wide, and take up valuable space inside the suitcase. Therefore, the traveller may choose not carry the hanger. As a result, the garment may need to be arranged a number of times by packing and/or unpacking followed by organizing on a hanger for maintaining desired shape and for accommodating the hangers inside the suitcase. This packing and/or unpacking and subsequent arrangement of garment for shipping and/or storage may create wrinkles, and be inconvenient. Wrinkling of the garment in a suitcase may require expensive trips to the dry cleaner and frequent ironing.

SUMMARY

A multi-hinged tri-folding garment hanger is disclosed. Disclosed are a method, a device and/or a system of a multi-hinged tri-folding garment hanger.

In one aspect, a garment hanger (e.g., multi-hinged tri-folding garment hanger) includes a central frame, a first vertical member, a second vertical member, a third vertical member, a fourth vertical member, and a hook member.

The central frame embodies a first arm toward a first end and a second arm toward a second end configured to support a first shoulder portion and a second shoulder portion of a garment respectively in an open state of the garment hanger. The central frame further includes a top portion and a bottom portion separated in space. In addition, the central frame includes a first double hinge joint on the top portion and a second double hinge joint on the bottom portion toward each of the first end and the second end around which correspondingly the first arm and the second arm are capable of folding back onto the central frame toward a center to form a folded state of the garment hanger.

The top portion includes a first top element of the central frame and a second top element of the first arm each connected to the first double hinge joint toward the first end. The second top element is closer to the first end than the first top element in the open state. Further, the top portion includes a third top element of the central frame and a fourth top element of the second arm each connected to the first double hinge joint toward the second end. The fourth top element is closer to the second end than the third top element in the open state.

The bottom portion includes a first bottom element of the central frame and a second bottom element of the first arm each connected to the second double hinge joint toward the first end. The second bottom element is closer to the first end than the first bottom element in the open state.

A third bottom element of the central frame and a fourth bottom element of the second arm are each connected to the second double hinge joint toward the second end. The fourth bottom element is closer to the second end than the third bottom element in the open state.

The first vertical member of the garment hanger connects the first top element to the first bottom element. The second vertical member of the garment hanger connects the second top element to the second bottom element. The third vertical member of the garment hanger connects the third top element to the third bottom element, and the fourth vertical member connects the fourth top element to the fourth bottom element. Each of the first vertical member, the second vertical member, the third vertical member and the fourth vertical member are parallel to a direction perpendicular to the direction connecting the first end to the second end.

Further, the hook member of the garment hanger is pivotably attached to the top portion of the central frame along another direction perpendicular to the direction connecting the first end to the second end. Another direction includes the center of the central frame. The hook member is configured to enable hanging of the garment in the open state.

In the open state, the first double hinge joint and the second double hinge joint toward the first end are further configured to be aligned approximately along a same direction as a length of the top portion and the bottom portion respectively of the central frame toward the first end. The first double hinge joint and the second double hinge joint toward the second end are further configured to be aligned approximately along the same direction as the length of the top portion and the bottom portion respectively of the central frame toward the second end.

The first double hinge joint toward the first end is configured to swingably move such that the first double hinge joint toward the first end is perpendicular to both the length of the top portion of the central frame toward the first end and a length of the first arm folded back onto the central frame toward the center in the folded state.

The second double hinge joint toward the first end is configured to swingably move such that the second double hinge joint toward the first end is perpendicular to both the length of the bottom portion of the central frame toward the first end and the length of the first arm folded back onto the central frame toward the center thereof in the folded state.

The first double hinge joint toward the second end is configured to swingably move such that the first double hinge joint toward the second end is perpendicular to both the length of the top portion of the central frame toward the second end and the length of the second arm folded back onto the central frame toward the center thereof in the folded state. The second double hinge joint toward the second end is configured to swingably move such that the second double hinge joint toward the second end is perpendicular to both the length of the bottom portion of the central frame toward the second end and the length of the second arm folded back onto the central frame toward the center thereof in the folded state.

Further, the hook member is configured to retractably fold to be disposed across the separation in space between the top portion and the bottom portion of the central frame and in contact with the bottom portion thereof. A most compact state of the garment hanger represents a most compact packing of the garment hanger that is equivalent to the folded state in which the hook member is additionally retractably folded to be disposed across the separation in space between the top portion and the bottom portion of the central frame and in contact with the bottom portion.

The first double hinge joint and the second double hinge joint may be made of a plastic material and/or a metallic material. Further, at least some portion of the garment hanger may be made of aluminium, a polymer, wood and/or steel.

The most compact state may be compatible with the garment being compactly packed along with the garment hanger without removal thereof. In addition, at least some portion of the garment hanger may be made of sustainable material. The garment hanger may further include at least one groove on the central frame to enable hanging of a corresponding at least one strap of the garment on the at least one groove. The first arm and the second arm may be both curved in shape. The first arm and the second arm may be equidistant from the center of the central frame.

In another aspect, a garment hanger includes a central frame embodying a first arm toward a first end and a second arm toward a second end. The first arm and the second arms are configured to support a first shoulder portion and a second shoulder portion of a garment respectively in an open state of the garment hanger. The first arm and the second arm are equidistant from a center of the central frame. Each of the first arm and the second arm are curved in shape.

The central frame further includes a top portion and a bottom portion separated in space. In addition, the central frame includes a first double hinge joint on the top portion and a second double hinge joint on the bottom portion toward each of the first end and the second end around which correspondingly the first arm and the second arm are capable of folding back onto the central frame toward the center to a folded state of the garment hanger.

The top portion further includes a first top element of the central frame and a second top element of the first arm each connected to the first double hinge joint toward the first end. The second top element is closer to the first end than the first top element in the open state. A third top element of the central frame and a fourth top element of the second arm are each connected to the first double hinge joint toward the second end. The fourth top element is closer to the second end than the third top element in the open state.

The bottom portion of the central frame further includes a first bottom element and a second bottom element of the first arm each connected to the second double hinge joint toward the first end. The second bottom element is closer to the first end than the first bottom element in the open state. A third bottom element of the central frame and a fourth bottom element of the second arm are each connected to the second double hinge joint toward the second end. The fourth bottom element is closer to the second end than the third bottom element in the open state.

The garment hanger further includes a first vertical member connecting the first top element to the first bottom element, a second vertical member connecting the second top element to the second bottom element, a third vertical member connecting the third top element to the third bottom element, and a fourth vertical member connecting the fourth top element to the fourth bottom element. Each of the first vertical member, the second vertical member, the third vertical member and the fourth vertical member are parallel to a direction perpendicular to the direction connecting the first end to the second end.

Furthermore, the garment hanger includes a hook member pivotably attached to the top portion of the central frame along another direction perpendicular to the direction connecting the first end to the second end. Another direction includes the center of the central frame thereon. The hook member is configured to enable hanging of the garment in the open state. In the open state, the first double hinge joint and the second double hinge joint toward the first end are further configured to be aligned approximately along a same direction as a length of the top portion and the bottom portion respectively of the central frame toward the first end.

The first double hinge joint and the second double hinge joint toward the second end are further configured to be aligned approximately along the same direction as the length of the top portion and the bottom portion respectively of the central frame toward the second end.

The first double hinge joint toward the first end is configured to swingably move such that the first double hinge joint toward the first end is perpendicular to both the length of the top portion of the central frame toward the first end and a length of the first arm folded back onto the central frame toward the center thereof in the folded state.

The second double hinge joint toward the first end is configured to swingably move such that the second double hinge joint toward the first end is perpendicular to both the length of the bottom portion of the central frame toward the first end and the length of the first arm folded back onto the central frame toward the center thereof in the folded state.

The first double hinge joint toward the second end is configured to swingably move such that the first double hinge joint toward the second end is perpendicular to both the length of the top portion of the central frame toward the second end and the length of the second arm folded back onto the central frame toward the center thereof in the folded state. The second double hinge joint toward the second end is configured to swingably move such that the second double hinge joint toward the second end is perpendicular to both the length of the bottom portion of the central frame toward the second end and the length of the second arm folded back onto the central frame toward the center thereof in the folded state.

The hook member is configured to retractably fold to be disposed across the separation in space between the top portion and the bottom portion of the central frame and in contact with the bottom portion thereof.

Furthermore, a most compact state of the garment hanger represents a most compact packing of the garment hanger that is equivalent to the folded state. The hook member is additionally retractably folded to be disposed across the separation in space between the top portion and the bottom portion of the central frame and in contact with the bottom portion thereof.

In yet another aspect, a garment hanger includes a central frame having a first arm toward a first end and a second arm toward a second end. The first arm and the second arm are configured to support a first shoulder portion and a second shoulder portion of a garment respectively in an open state of the garment hanger. The first arm and the second arm are equidistant from a center of the central frame.

The central frame further includes a top portion and a bottom portion separated in space. In addition, the central frame includes a first double hinge joint on the top portion and a second double hinge joint on the bottom portion toward each of the first end and the second end around which correspondingly the first arm and the second arm are capable of folding back onto the central frame toward the center to a folded state of the garment hanger.

Furthermore, the top portion includes a first top element of the central frame and a second top element of the first arm each connected to the first double hinge joint toward the first end. The second top element is closer to the first end than the first top element in the open state. A third top element of the central frame and a fourth top element of the second arm are each connected to the first double hinge joint toward the second end. The fourth top element is closer to the second end than the third top element in the open state. The bottom portion further includes a first bottom element of the central frame and a second bottom element of the first arm each connected to the second double hinge joint toward the first end. The second bottom element is closer to the first end than the first bottom element in the open state. A third bottom element of the central frame and a fourth bottom element of the second arm are each connected to the second double hinge joint toward the second end. The fourth bottom element is closer to the second end than the third bottom element in the open state.

The garment hanger further includes a first vertical member connecting the first top element to the first bottom element, a second vertical member connecting the second top element to the second bottom element, a third vertical member connecting the third top element to the third bottom element, and a fourth vertical member connecting the fourth top element to the fourth bottom element. Each of the first vertical member, the second vertical member, the third vertical member and the fourth vertical member are parallel to a direction perpendicular to the direction connecting the first end to the second end.

Additionally, the garment hanger includes a hook member pivotably attached to the top portion of the central frame along another direction perpendicular to the direction connecting the first end to the second end. Another direction includes the center of the central frame thereon. The hook member is configured to enable hanging of the garment in the open state.

In the open state, the first double hinge joint and the second double hinge joint toward the first end are further configured to be aligned approximately along a same direction as a length of the top portion and the bottom portion respectively of the central frame toward the first end. The first double hinge joint and the second double hinge joint toward the second end are further configured to be aligned approximately along the same direction as the length of the top portion and the bottom portion respectively of the central frame toward the second end.

The first double hinge joint toward the first end is configured to swingably move such that the first double hinge joint toward the first end is perpendicular to both the length of the top portion of the central frame toward the first end and a length of the first arm folded back onto the central frame toward the center thereof in the folded state.

The second double hinge joint toward the first end is configured to swingably move such that the second double hinge joint toward the first end is perpendicular to both the length of the bottom portion of the central frame toward the first end and the length of the first arm folded back onto the central frame toward the center thereof in the folded state.

The first double hinge joint toward the second end is configured to swingably move such that the first double hinge joint toward the second end is perpendicular to both the length of the top portion of the central frame toward the second end and the length of the second arm folded back onto the central frame toward the center thereof in the folded state.

The second double hinge joint toward the second end is configured to swingably move such that the second double hinge joint toward the second end is perpendicular to both the length of the bottom portion of the central frame toward the second end and the length of the second arm folded back onto the central frame toward the center thereof in the folded state.

The hook member is configured to retractably fold to be disposed across the separation in space between the top portion and the bottom portion of the central frame and in contact with the bottom portion thereof.

A most compact state of the garment hanger represents a most compact packing of the garment hanger that is equivalent to the folded state in which the hook member is additionally retractably folded to be disposed across the separation in space between the top portion and the bottom portion of the central frame and in contact with the bottom portion thereof.

The most compact state of the garment hanger is compatible with the garment being compactly packed along with the garment hanger without removal thereof.

The methods and systems disclosed herein may be implemented in any means for achieving various aspects. Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which.

Figure 1:
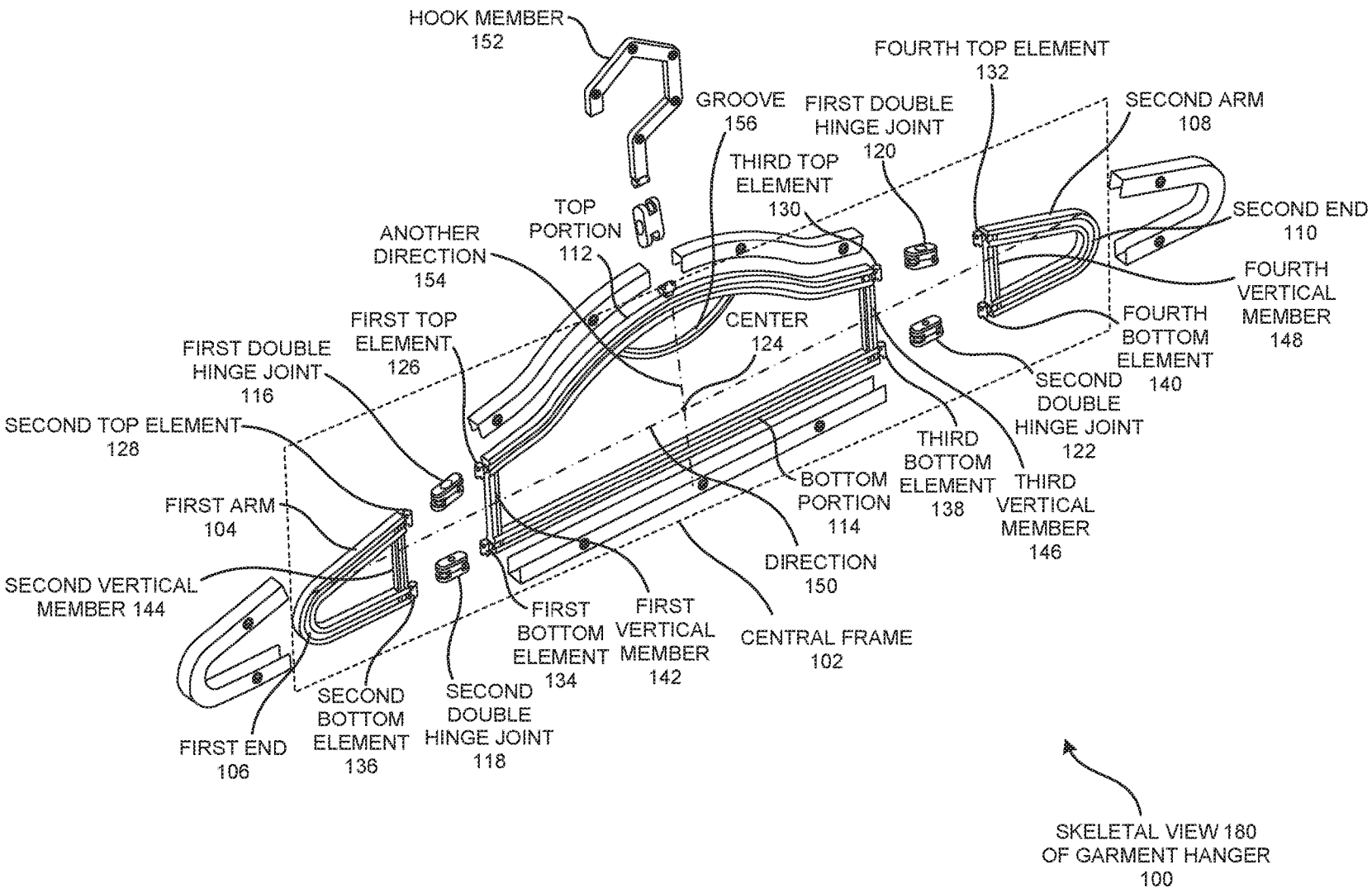
FIG. 1 is a skeletal view of a garment hanger illustrating the constituting elements of the garment hanger, according to one embodiment.

Other features of the present embodiments will be apparent from the accompanying drawings and from the detailed description that follows.

DETAILED DESCRIPTION

A multi-hinged tri-folding garment hanger is disclosed. Example embodiments, as described below, may be used to provide a method, a system and/or a device of a multi-hinged tri-folding garment hanger (e.g., garment hanger 100).

In one embodiment, a garment hanger 100 includes a central frame 102, a first vertical member 142, a second vertical member 144, a third vertical member 146, a fourth vertical member 148, and a hook member 152.

The central frame 102 embodies a first arm 104 toward a first end 106 and a second arm 108 toward a second end 110 configured to support a first shoulder portion 602 and a second shoulder portion 604 of a garment 650 respectively in an open state 200 of the garment hanger 100. The central frame 102 further includes a top portion 112 and a bottom portion 114 separated in space. In addition, the central frame 102 includes a first double hinge joint 116 on the top portion 112 and a second double hinge joint 118 on the bottom portion 114 toward each of the first end 106 and the second end 110 around which correspondingly the first arm 104 and the second arm 108 are capable of folding back onto the central frame 102 toward a center 124 thereof to a folded state 600 of the garment hanger 100.

The top portion 112 includes a first top element 126 of the central frame 102 and a second top element 128 of the first arm 104 each connected to the first double hinge joint 116 toward the first end 106. The second top element 128 is closer to the first end 106 than the first top element 126 in the open state 200. Further, the top portion 112 includes a third top element 130 of the central frame 102 and a fourth top element 132 of the second arm 108 each connected to the first double hinge joint 120 toward the second end 110. The fourth top element 132 is closer to the second end 110 than the third top element 130 in the open state 200.

The bottom portion 114 includes a first bottom element 134 of the central frame 102 and a second bottom element 136 of the first arm 104 each connected to the second double hinge joint 118 toward the first end 106. The second bottom element 136 is closer to the first end 106 than the first bottom element 134 in the open state 200.

A third bottom element 138 of the central frame 102 and a fourth bottom element 140 of the second arm 108 are each connected to the second double hinge joint 118 toward the second end 110. The fourth bottom element 140 is closer to the second end 110 than the third bottom element 138 in the open state 200.

The first vertical member 142 of the garment hanger 100 connects the first top element 126 to the first bottom element 134. The second vertical member 144 of the garment hanger 100 connects the second top element 128 to the second bottom element 136. The third vertical member 146 of the garment hanger 100 connects the third top element 130 to the third bottom element 138, and the fourth vertical member 148 connects the fourth top element 132 to the fourth bottom element 140. Each of the first vertical member 142, the second vertical member 144, the third vertical member 146 and the fourth vertical member 148 are parallel to a direction 150 perpendicular to the direction 150 connecting the first end 106 to the second end 110.

Further, the hook member 152 of the garment hanger 100 is pivotably attached to the top portion 112 of the central frame 102 along another direction 154 perpendicular to the direction connecting the first end 106 to the second end 110. Another direction 154 includes the center 124 of the central frame 102. The hook member 152 is configured to enable hanging of the garment 650 in the open state 200.

In the open state 200, the first double hinge joint 116 and the second double hinge joint 118 toward the first end 106 are further configured to be aligned approximately along a same direction as a length of the top portion 112 and the bottom portion 114 respectively of the central frame 102 toward the first end 106. The first double hinge joint 120 and the second double hinge joint 122 toward the second end 110 are further configured to be aligned approximately along the same direction as the length of the top portion 112 and the bottom portion 114 respectively of the central frame 102 toward the second end 110.

The first double hinge joint 116 toward the first end 106 is configured to swingably move such that the first double hinge joint 116 toward the first end 106 is perpendicular to both the length of the top portion 112 of the central frame 102 toward the first end 106 and a length of the first arm 104 folded back onto the central frame 102 toward the center 124 in the folded state 600.

The second double hinge joint 118 toward the first end 106 is configured to swingably move such that the second double hinge joint 118 toward the first end 106 is perpendicular to both the length of the bottom portion 114 of the central frame 102 toward the first end 106 and the length of the first arm 104 folded back onto the central frame 102 toward the center 124 thereof in the folded state 600.

The first double hinge joint 120 toward the second end 110 is configured to swingably move such that the first double hinge joint 120 toward the second end 110 is perpendicular to both the length of the top portion 112 of the central frame 102 toward the second end 110 and the length of the second arm 108 folded back onto the central frame 102 toward the center 124 thereof in the folded state 600. The second double hinge joint 118 toward the second end 110 is configured to swingably move such that the second double hinge joint 118 toward the second end 110 is perpendicular to both the length of the bottom portion 114 of the central frame 102 toward the second end 110 and the length of the second arm 108 folded back onto the central frame 102 toward the center 124 thereof in the folded state 600.

Further, the hook member 152 is configured to retractably fold to be disposed across the separation in space between the top portion 112 and the bottom portion 114 of the central frame 102 and in contact with the bottom portion 114 thereof. A most compact state 400 of the garment hanger 100 represents a most compact packing of the garment hanger 100 that is equivalent to the folded state 600 in which the hook member 152 is additionally retractably folded to be disposed across the separation in space between the top portion 112 and the bottom portion 114 of the central frame 102 and in contact with the bottom portion 114.

The first double hinge joint 116 (e.g., analogous to first double hinge joint 120) and the second double hinge joint 118 (e.g., analogous to second double hinge joint 122) may be made of a plastic material and/or a metallic material. Further, at least some portion of the garment hanger 100 may be made of aluminium, a polymer, wood and/or steel.

The most compact state 400 may be compatible with the garment 650 being compactly packed along with the garment hanger 100 without removal thereof. In addition, at least some portion of the garment hanger 100 may be made of sustainable material. The garment hanger 100 may further include at least one groove 156 on the central frame 102 to enable hanging of a corresponding at least one strap of the garment 650 on the at least one groove 156. The first arm 104 and the second arm 108 may be both curved in shape. The first arm 104 and the second arm 108 may be equidistant from the center 124 of the central frame 102.

In another embodiment, a garment hanger 100 includes a central frame 102 embodying a first arm 104 toward a first end 106 and a second arm 108 toward a second end 110. The first arm 104 and the second arm 108 are configured to support a first shoulder portion 602 and a second shoulder portion 604 of a garment 650 respectively in an open state 200 of the garment hanger 100. The first arm 104 and the second arm 108 are equidistant from a center 124 of the central frame 102. Each of the first arm 104 and the second arm 108 are curved in shape.

The central frame 102 further includes a top portion 112 and a bottom portion 114 separated in space. In addition, the central frame 102 includes a first double hinge joint 116 (e.g., first double hinge joint 120) on the top portion 112 and a second double hinge joint 118 (e.g., second double hinge joint 122) on the bottom portion 114 toward each of the first end 106 and the second end 110 around which correspondingly the first arm 104 and the second arm 108 are capable of folding back onto the central frame 102 toward the center 124 to a folded state 600 of the garment hanger 100.

The top portion 112 further includes a first top element 126 of the central frame 102 and a second top element 128 of the first arm 104 each connected to the first double hinge joint 116 toward the first end 106. The second top element 128 is closer to the first end 106 than the first top element 126 in the open state 200. A third top element 130 of the central frame 102 and a fourth top element 132 of the second arm 108 are each connected to the first double hinge joint 120 toward the second end 110. The fourth top element 132 is closer to the second end 110 than the third top element 130 in the open state 200.

The bottom portion 114 of the central frame 102 further includes a first bottom element 134 and a second bottom element 136 of the first arm 104 each connected to the second double hinge joint 118 toward the first end 106. The second bottom element 136 is closer to the first end 106 than the first bottom element 134 in the open state 200. A third bottom element 138 of the central frame 102 and a fourth bottom element 140 of the second arm 108 are each connected to the second double hinge joint 118 toward the second end 110. The fourth bottom element 140 is closer to the second end 110 than the third bottom element 138 in the open state 200.

The garment hanger 100 further includes a first vertical member 142 connecting the first top element 126 to the first bottom element 134, a second vertical member 144 connecting the second top element 128 to the second bottom element 136, a third vertical member 146 connecting the third top element 130 to the third bottom element 138, and a fourth vertical member 148 connecting the fourth top element 132 to the fourth bottom element 140. Each of the first vertical member 142, the second vertical member 144, the third vertical member 146 and the fourth vertical member 148 are parallel to a direction perpendicular to the direction connecting the first end 106 to the second end 110.

Furthermore, the garment hanger 100 includes a hook member 152 pivotably attached to the top portion 112 of the central frame 102 along another direction 154 perpendicular to the direction connecting the first end 106 to the second end 110. Another direction 154 includes the center 124 of the central frame 102 thereon. The hook member 152 is configured to enable hanging of the garment 650 in the open state 200. In the open state 200, the first double hinge joint 116 and the second double hinge joint 118 toward the first end 106 are further configured to be aligned approximately along a same direction as a length of the top portion 112 and the bottom portion 114 respectively of the central frame 102 toward the first end 106.

The first double hinge joint 120 and the second double hinge joint 122 toward the second end 110 are further configured to be aligned approximately along the same direction as the length of the top portion 112 and the bottom portion 114 respectively of the central frame 102 toward the second end 110.

The first double hinge joint 116 toward the first end 106 is configured to swingably move such that the first double hinge joint 116 toward the first end 106 is perpendicular to both the length of the top portion 112 of the central frame 102 toward the first end 106 and a length of the first arm 104 folded back onto the central frame 102 toward the center 124 thereof in the folded state 600.

The second double hinge joint 118 toward the first end 106 is configured to swingably move such that the second double hinge joint 118 toward the first end 106 is perpendicular to both the length of the bottom portion 114 of the central frame 102 toward the first end 106 and the length of the first arm 104 folded back onto the central frame 102 toward the center 124 thereof in the folded state 600.

The first double hinge joint 120 toward the second end 110 is configured to swingably move such that the first double hinge joint 120 toward the second end 110 is perpendicular to both the length of the top portion 112 of the central frame 102 toward the second end 110 and the length of the second arm 108 folded back onto the central frame 102 toward the center 124 thereof in the folded state 600. The second double hinge joint 122 toward the second end 110 is configured to swingably move such that the second double hinge joint 122 toward the second end 110 is perpendicular to both the length of the bottom portion 114 of the central frame 102 toward the second end 110 and the length of the second arm 108 folded back onto the central frame 102 toward the center 124 thereof in the folded state 600.

The hook member 152 is configured to retractably fold to be disposed across the separation in space between the top portion 112 and the bottom portion 114 of the central frame 102 and in contact with the bottom portion 114 thereof.

Furthermore, a most compact state 400 of the garment hanger 100 represents a most compact packing of the garment hanger 100 that is equivalent to the folded state 600. The hook member 152 is additionally retractably folded to be disposed across the separation in space between the top portion 112 and the bottom portion 114 of the central frame 102 and in contact with the bottom portion 114 thereof.

In yet another embodiment, a garment hanger 100 includes a central frame 102 having a first arm 104 toward a first end 106 and a second arm 108 toward a second end 110. The first arm 104 and the second arm 108 are configured to support a first shoulder portion 602 and a second shoulder portion 604 of a garment 650 respectively in an open state 200 of the garment hanger 100. The first arm 104 and the second arm 108 are equidistant from a center 124 of the central frame 102.

The central frame 102 further includes a top portion 112 and a bottom portion 114 separated in space. In addition, the central frame 102 includes a first double hinge joint 116 (e.g., analogous to first double hinge joint 120) on the top portion 112 and a second double hinge joint 118 (e.g., analogous to second double hinge joint 122) on the bottom portion 114 toward each of the first end 106 and the second end 110 around which correspondingly the first arm 104 and the second arm 108 are capable of folding back onto the central frame 102 toward the center 124 to a folded state 600 of the garment hanger 100.

Furthermore, the top portion 112 includes a first top element 126 of the central frame 102 and a second top element 128 of the first arm 104 each connected to the first double hinge joint 116 toward the first end 106. The second top element 128 is closer to the first end 106 than the first top element 126 in the open state 200. A third top element 130 of the central frame 102 and a fourth top element 132 of the second arm 108 are each connected to the first double hinge joint 120 toward the second end 110. The fourth top element 132 is closer to the second end 110 than the third top element 130 in the open state 200. The bottom portion 114 further includes a first bottom element 134 of the central frame 102 and a second bottom element 136 of the first arm 104 each connected to the second double hinge joint 118 toward the first end 106. The second bottom element 136 is closer to the first end 106 than the first bottom element 134 in the open state 200. A third bottom element 138 of the central frame 102 and a fourth bottom element 140 of the second arm 108 are each connected to the second double hinge joint 118 toward the second end 110. The fourth bottom element 140 is closer to the second end 110 than the third bottom element 138 in the open state 200.

The garment hanger 100 further includes a first vertical member 142 connecting the first top element 126 to the first bottom element 134, a second vertical member 144 connecting the second top element 128 to the second bottom element 136, a third vertical member 146 connecting the third top element 130 to the third bottom element 138, and a fourth vertical member 148 connecting the fourth top element 132 to the fourth bottom element 140. Each of the first vertical member 142, the second vertical member 144, the third vertical member 146 and the fourth vertical member 148 are parallel to a direction perpendicular to the direction connecting the first end 106 to the second end 110.

Additionally, the garment hanger 100 includes a hook member 152 pivotably attached to the top portion 112 of the central frame 102 along another direction 154 perpendicular to the direction connecting the first end 106 to the second end 110. Another direction 154 includes the center 124 of the central frame 102 thereon. The hook member 152 is configured to enable hanging of the garment 650 in the open state 200.

In the open state 200, the first double hinge joint 116 and the second double hinge joint 118 toward the first end 106 are further configured to be aligned approximately along a same direction as a length of the top portion 112 and the bottom portion 114 respectively of the central frame 102 toward the first end 106. The first double hinge joint 120 and the second double hinge joint 122 toward the second end 110 are further configured to be aligned approximately along the same direction as the length of the top portion 112 and the bottom portion 114 respectively of the central frame 102 toward the second end 110.

The first double hinge joint 116 toward the first end 106 is configured to swingably move such that the first double hinge joint 116 toward the first end 106 is perpendicular to both the length of the top portion 112 of the central frame 102 toward the first end 106 and a length of the first arm 104 folded back onto the central frame 102 toward the center 124 thereof in the folded state 600.

The second double hinge joint 118 toward the first end 106 is configured to swingably move such that the second double hinge joint 118 toward the first end 106 is perpendicular to both the length of the bottom portion 114 of the central frame 102 toward the first end 106 and the length of the first arm 104 folded back onto the central frame 102 toward the center 124 thereof in the folded state 600.

The first double hinge joint 120 toward the second end 110 is configured to swingably move such that the first double hinge joint 120 toward the second end 110 is perpendicular to both the length of the top portion 112 of the central frame 102 toward the second end 110 and the length of the second arm 108 folded back onto the central frame 102 toward the center 124 thereof in the folded state 600.

The second double hinge joint 118 toward the second end 110 is configured to swingably move such that the second double hinge joint 118 toward the second end 110 is perpendicular to both the length of the bottom portion 114 of the central frame 102 toward the second end 110 and the length of the second arm 108 folded back onto the central frame 102 toward the center 124 thereof in the folded state 600.

The hook member 152 is configured to retractably fold to be disposed across the separation in space between the top portion 112 and the bottom portion 114 of the central frame 102 and in contact with the bottom portion 114 thereof.

A most compact state 400 of the garment hanger 100 represents a most compact packing of the garment hanger 100 that is equivalent to the folded state 600 in which the hook member 152 is additionally retractably folded to be disposed across the separation in space between the top portion 112 and the bottom portion 114 of the central frame 102 and in contact with the bottom portion 114 thereof.

The most compact state 400 of the garment hanger 100 is compatible with the garment 650 being compactly packed along with the garment hanger 100 without removal thereof.

FIG. 1 is a skeletal view 180 of a garment hanger 100 illustrating the constituting elements of the garment hanger 100, according to one embodiment. Particularly, FIG. 1 illustrates a schematic of the garment hanger 100 showing the order of assembly of various components of the garment hanger 100. The garment hanger 100 may be fabricated by assembling various components as shown in the figure. Each of the components of the garment hanger 100 are separated to show the entire structure of the garment hanger 100. Various components of the garment hanger 100 such as top portion 112, bottom portion 114, first arm 104, and second arm 108 of the central frame 102 may be made of a wire and/or thin, flat sheet or strip of a sustainable material. Each component of the central frame 102 (e.g., top portion 112, bottom portion 114, first arm 104, and second arm 108) may have a longitudinal flange forming an external ridge on the component.

Each of these components may further be covered by a lid-like casing. The lid-like casing may be clutched over the longitudinal flange to affix the lid-like casing onto the components (e.g., top portion 112, bottom portion 114, first arm 104, and second arm 108) of the central frame 102. As shown in the figure, the lid-like casing over each component of the central frame 102 (e.g., top portion 112, bottom portion 114, first arm 104, and second arm 108) may provide rigidity to the frame of the garment hanger 100 to prevent bending. The entire frame and the lid-like casing may be made of a sustainable material (e.g., polyfiber, aluminium, steel, wood, cork, bamboo etc.) to provide a smooth finish and/or texture to the garment hanger 100. The fabrication of the garment hanger 100 using the sustainable material may make it sturdy and durable. The smooth lid-like casing of the garment hanger 100 may allow easy handling of the garment supported by the garment hanger 100. Further, the lid-like casing of the garment hanger 100 may prevent any snag to cause damage to fabric and/or tear of the garment, according to one embodiment.

The first top element 126 at a first end 106 of the top portion 112 of the central frame 102 may have a pin-like protruding section to affix onto a first slot provided at one end of the first double hinge joint 116. Similarly, the first arm 104 may have the pin-like protruding section forming the second top element 128 to affix onto a second slot provided at the other end of the first double hinge joint 116. Analogous to the first top element 126, the first bottom element 134 and the second bottom element 136 may have the pin-like protruding sections, to affix onto the slots provided in the second double hinge joint 118. The pin-like protruding section affixed onto the slots of the first double hinge joint 116 and the second double hinge joint 118 may provide a free horizontal movement of the first arm 104 towards the center 124. The free horizontal movement of the first arm 104 enables folding back of the first arm 104 onto the central frame 102, according to one embodiment.

According to one embodiment, the first end 106 and the second end 110 may be equidistant from the center 124 in a direction 150 parallel to the central frame 102. The top portion 112 of the garment hanger 100 may have a curved profile towards the center 124.

Analogous to the first top element 126, the first bottom element 134, second top element 128, and the second bottom element 136 discussed above, the third top element 130, the third bottom element 138, fourth top element 132, and fourth bottom element 140 may have similar pin-like protruding sections, to affix onto the slots provided in the first double hinge joint 120 and second double hinge joint 122 respectively. The first double hinge joint 120 and second double hinge joint 122 may allow free horizontal movement of the second arm 108 towards the center 124. The free horizontal movement of the second arm 108 may enable folding back of the second arm 108 to overlap onto the central frame 102, according to one embodiment.

The first vertical member 142 adjacent to the first top element 126 at the end of the top portion 112 may be configured to connect the top portion 112 to the bottom portion 114 to provide stiffness to the central frame 102. Analogous to the first vertical member 142, second vertical member 144, the third vertical member 146 and the fourth vertical member 148 may be configured to connect the second top element 128 to the second bottom element 136, third top element 130 to the third bottom element 138, and the fourth top element 132 to the fourth bottom element 140 respectively, according to one embodiment.

The hook member 152 pivotably attached to the top portion 112 of the central frame 102 may be configured to enable hanging of the garment 650 in the open state 200. The hook member 152 may be configured to retractably fold along another direction 154 between the top portion 112 and the bottom portion 114 to achieve the most compact state 400 of the garment hanger 100. The groove 156 provided on the central frame 102 may enable hanging of garment 650 having straps such that the garment 650 does not slip from its position and/or fall down, according to one embodiment. The groove 156 at the top portion 112 may provide stiffness to the central frame 102.

Figure 2:
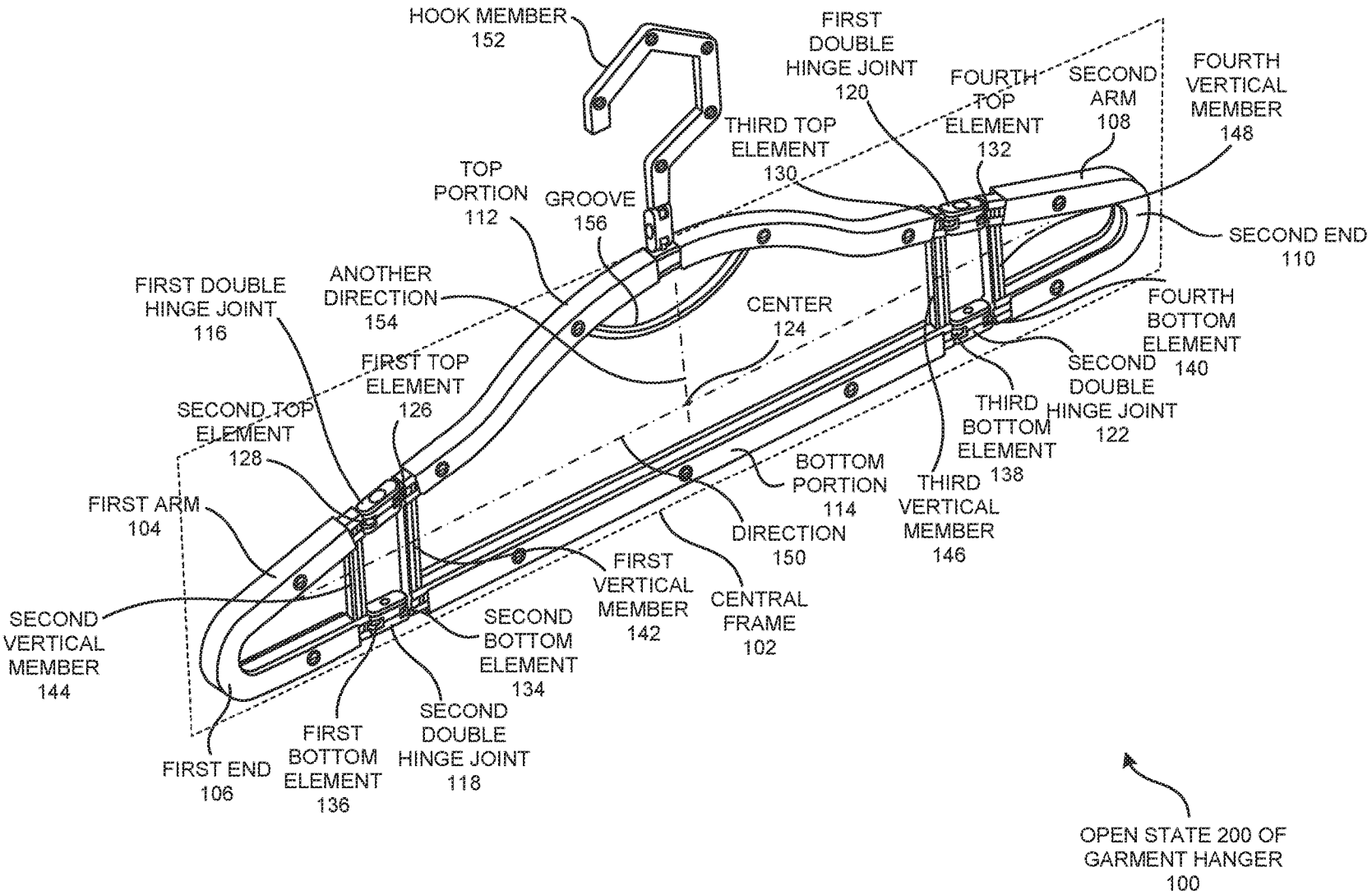
FIG. 2 is a schematic view of the garment hanger of FIG. 1 illustrating an open state of the garment hanger, according to one embodiment.

FIG. 2 is a schematic view of the garment hanger 100 of FIG. 1 illustrating an open state 200 of the garment hanger 100, according to one embodiment. FIG. 2 illustrates the assembled view of the garment hanger 100 wherein each of the central frame 102 component may be connected to the corresponding elements as described above and shown in FIG. 1. Additionally, each of the central frame 102 component may be covered by the lid-like casing. The first double hinge joint 116 (e.g., analogous to the first double hinge joint 120) and the second double hinge joint 118 (e.g., analogous to the second double hinge joint 122) may be configured such that each double hinge joint remains in alignment with the top portion 112 and the bottom portion 114 respectively of the central frame 102 in the open state 200 as shown in FIG. 2. In addition, the hook member 152 may remain upright in the open state 200.

Figure 3A:
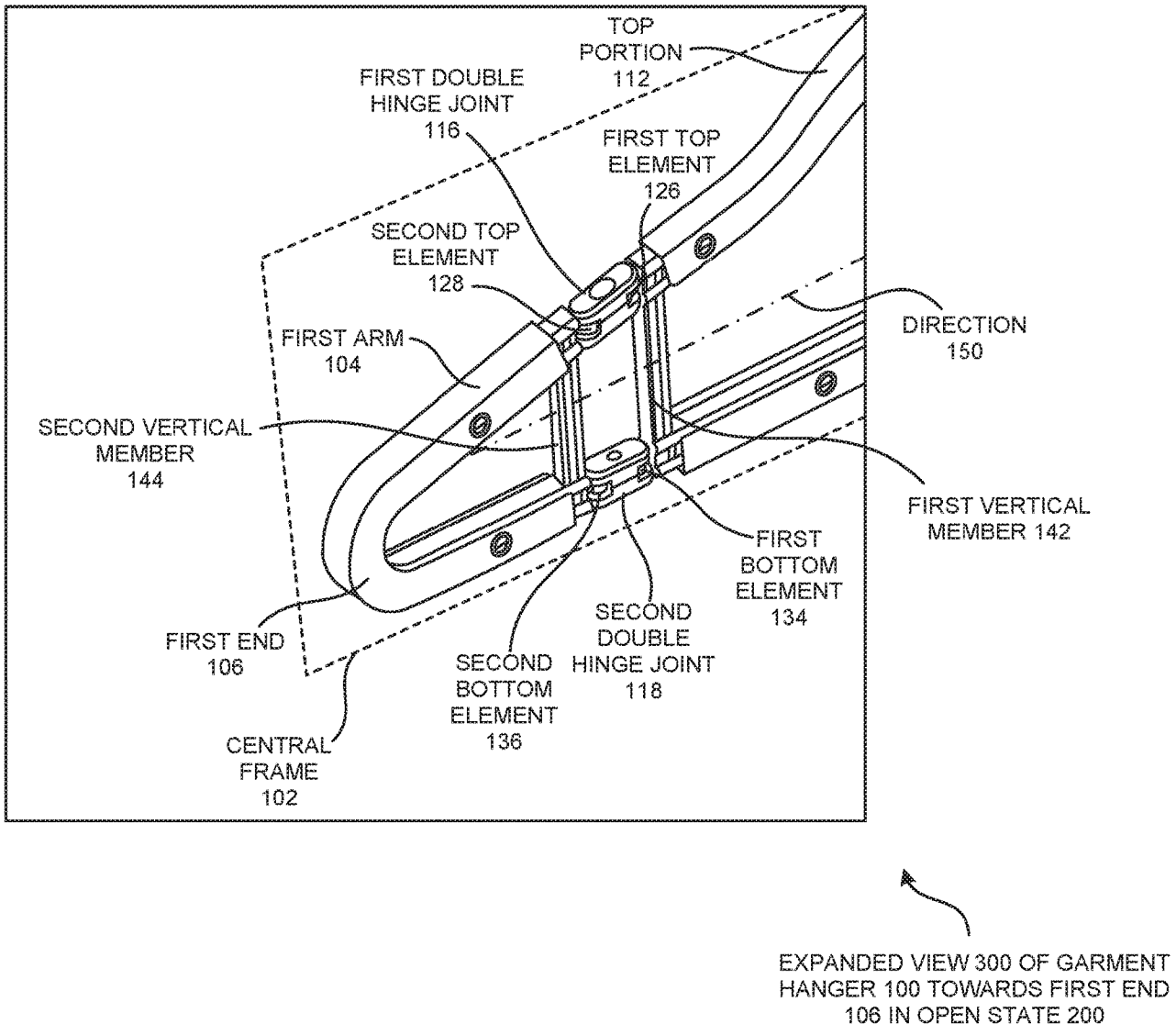
FIG. 3A is an expanded view of the garment hanger of FIG. 1 illustrating a first end of the garment hanger in an open state, according to one embodiment.

FIG. 3A is an expanded view 300 of the garment hanger 100 of FIG. 1 illustrating a first end 106 of the garment hanger 100 in the open state 200, according to one embodiment. The expanded view 300 is an exemplary representation of a partial segment of the garment hanger 100 to illustrate a more detailed view of the garment hanger 100 to help explain the connections of the various components of each of the garment hanger 100. For example, first top element 126 and second top element 128 may be connected to the first double hinge joint 116 by affixing it onto the slots provided on both of its sides as shown in the figure. The various components of the garment hanger 100 in the second arm 108 may be correspondingly assembled analogous to the components of the first arm 104.

Figure 3B:
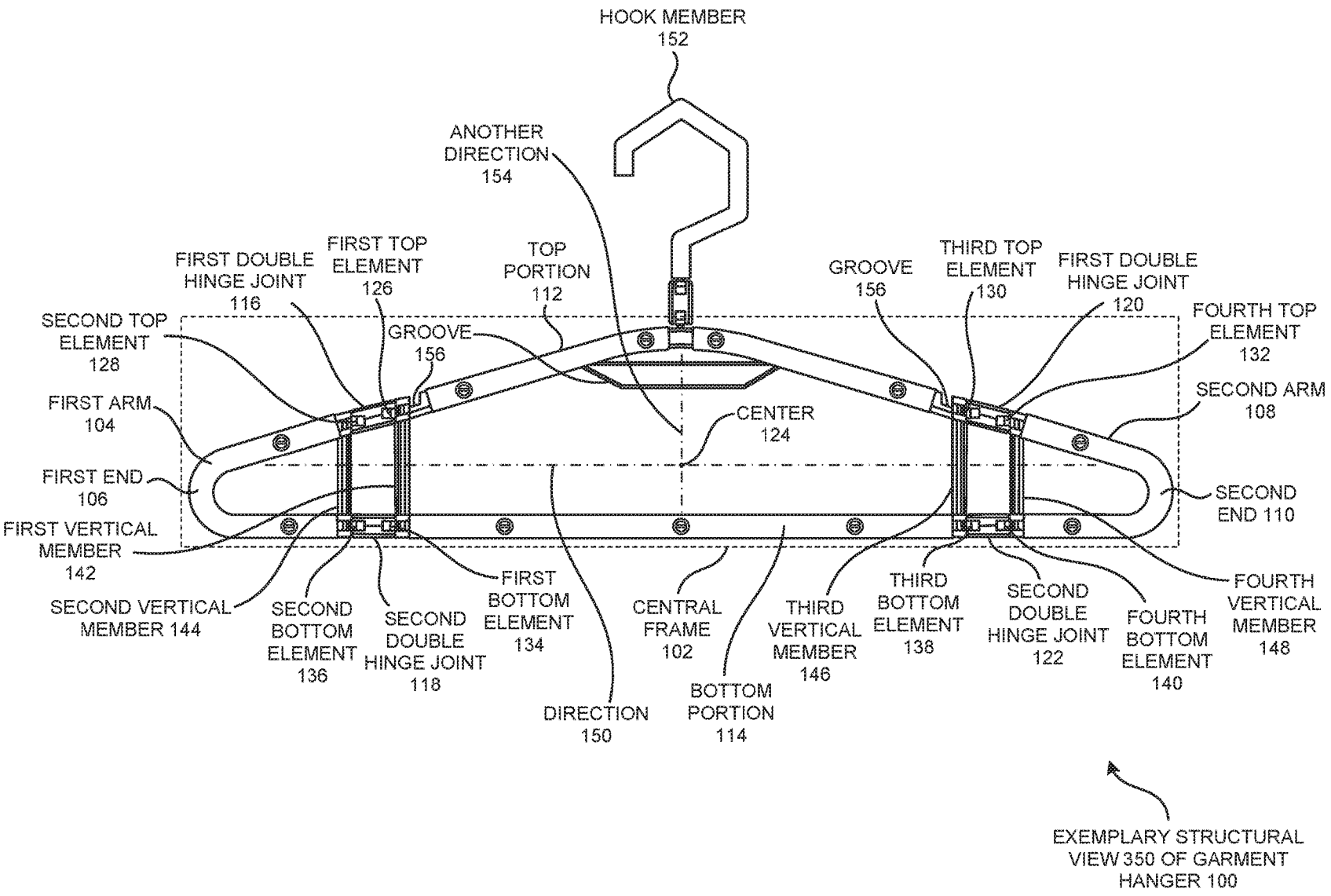
FIG. 3B is an exemplary structural view of another embodiment of the garment hanger of FIG. 1 illustrating an open state of the garment hanger, according to one embodiment.

FIG. 3B is an exemplary structural view 350 of another embodiment of the garment hanger 100 of FIG. 1 illustrating an open state 200 of the garment hanger 100, according to one embodiment.

In another embodiment, the top portion 112 of the garment hanger 100 may have a straight inclined profile towards the center 124 as shown in FIG. 3B. Further, the garment hanger 100 may have a notch at both the ends of the top portion 112 of the garment hanger 100 to form the grooves 156. The groove 156 may enable the strap of the garment to be held suspended from the notch when garment is secured onto the garment hanger 100 while hanging from the hook member 152.

Figure 4:
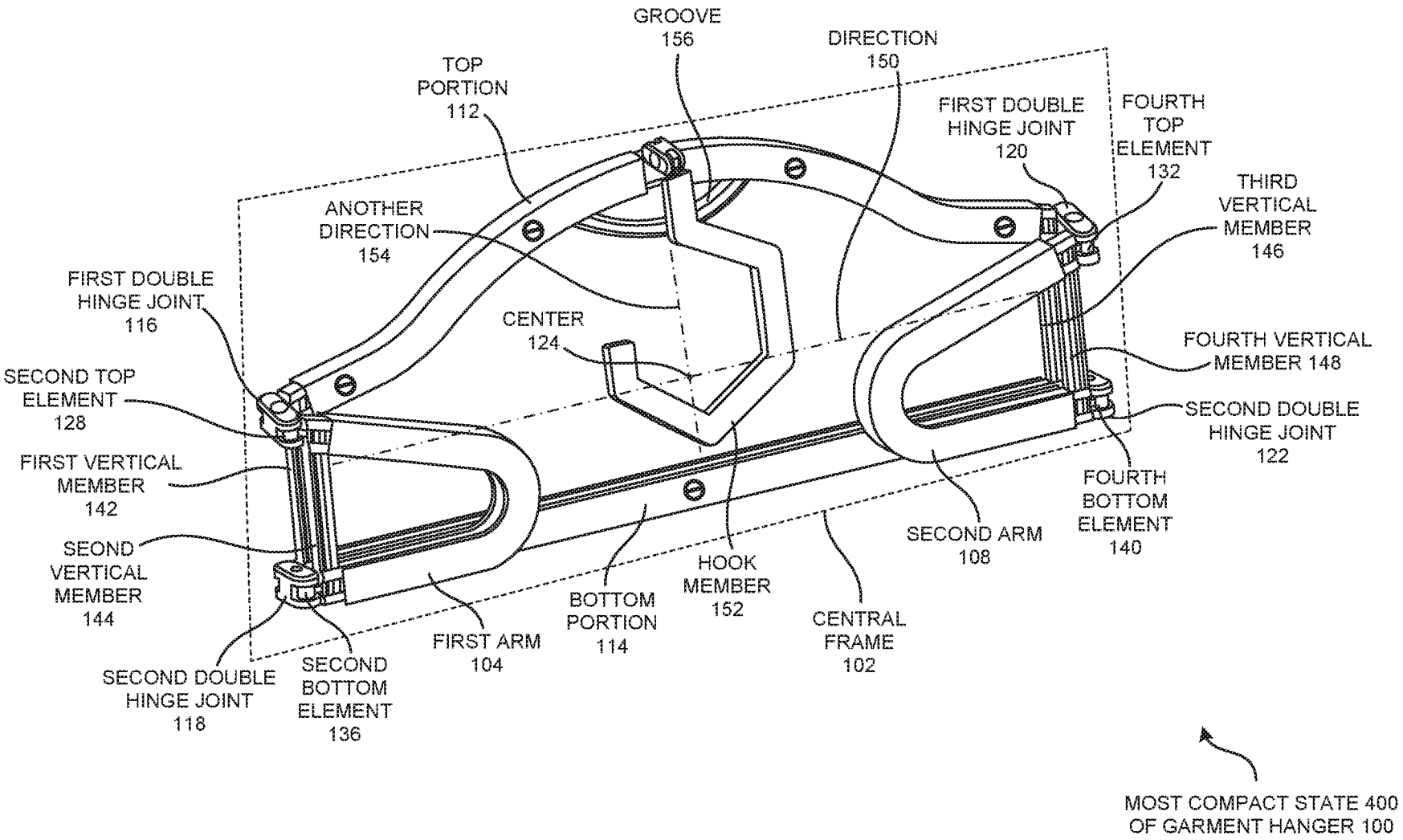
FIG. 4 is a schematic view of the garment hanger of FIG. 1 illustrating a most compact state of the garment hanger, according to one embodiment.

FIG. 4 is a schematic view of the garment hanger 100 of FIG. 1 illustrating a most compact state 400 of the garment hanger 100, according to one embodiment. The first double hinge joint 116 at the top portion 112 and corresponding second double hinge joint 118 at the bottom may be configured such that the joints may be rotated perpendicularly to the central frame 102 alignment.

In the rotated position, the first arm 104 and the second arm 108 are folded back to overlap onto the bottom portion 114 towards the center 124 as shown in FIG. 2. This perpendicular rotation of the double hinge joints may enable the garment hanger 100 to transform from an open state 200 to the folded state 600. Further, the hook member 152 may be folded so as to situate between the top portion 112 and the bottom portion 114 of the central frame 102 to form the most compact state 400, according to one embodiment.

In one embodiment, the second vertical member 144 may overlap the first vertical member 142 in the most compact state 400 as shown in FIG. 4. Similarly, the fourth vertical member 148 may overlap the third vertical member 146 in the most compact state 400.

Figure 5:
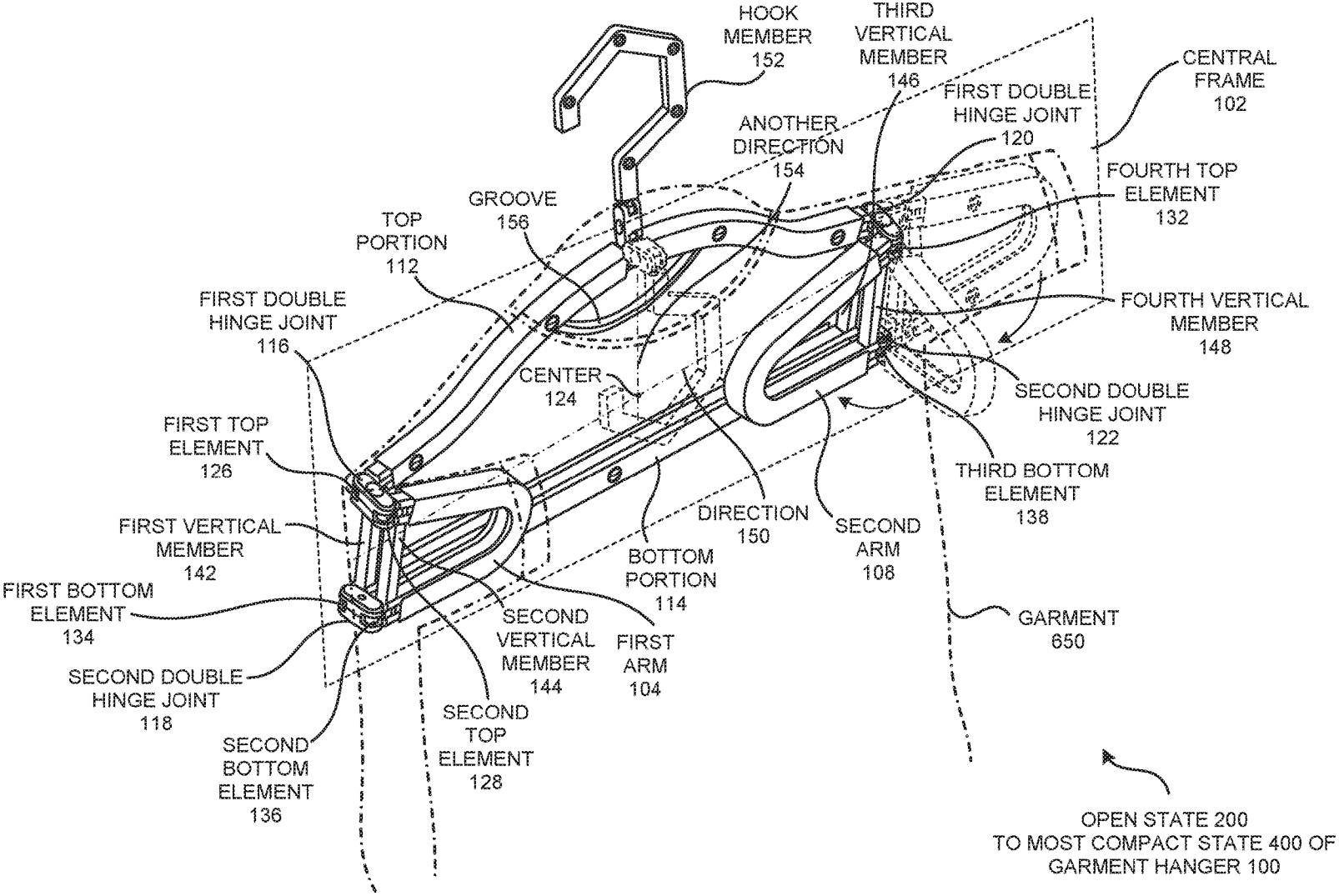
FIG. 5 is a schematic view of the garment hanger of FIG. 1 illustrating folding of the garment hanger from the open state to the most compact state with garment supported by the garment hanger, according to one embodiment.

FIG. 5 is a schematic view of the garment hanger 100 of FIG. 1 illustrating folding of the garment hanger 100 from the open state 200 to the most compact state 400 with garment 650 supported in the place by the garment hanger 100, according to one embodiment. As shown in FIG. 5, the garment hanger 100 may be positioned inside the garment 650 to hang it using the hook member 152. Each of the first arm 104 and the second arm 108 may support each of the shoulder portions of the garment 650. Each of the first arm 104 and the second arm 108, supporting the shoulder portions (e.g., first shoulder portion 602, second shoulder portion 604) of the garment 650, may be rotated towards the center 124 with the garment 650 still arranged on the garment hanger 100, to form a folded state 600.

The hook member 152 may further be folded so as to situate between the top portion 112 and the bottom portion 114 of the central frame 102 to form the most compact state 400 while the garment 650 is still positioned on the garment hanger 100, according to one embodiment.

Figure 6:
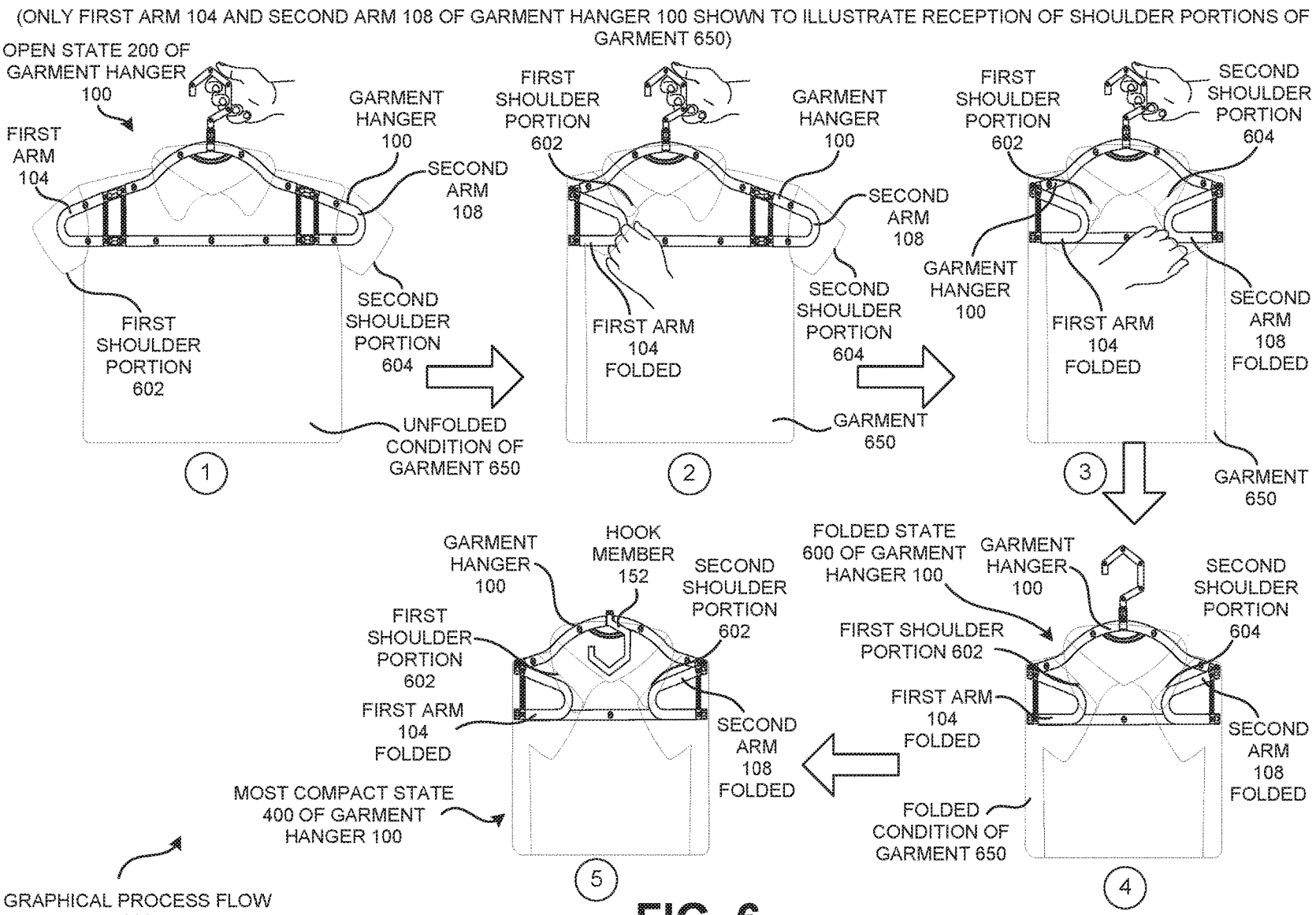
FIG. 6 is a graphical process flow illustrating the steps involved in folding of the garment using the garment hanger of FIG. 1 to the most compact state of the garment hanger without removing the garment from the garment hanger, according to one embodiment.

FIG. 6 is a graphical process flow 680 illustrating the steps involved in folding the garment 650 using the garment hanger 100 of FIG. 1 to the most compact state 400 of the garment hanger 100 without removing the garment 650 from the garment hanger 100, according to one embodiment. As shown in circle "1", shoulder portions of the garment 650 may be supported by the garment hanger 100 in an open state 200 to hang the garment 650 freely using the hook member 152, with hook member 152 remaining upright. In circle "2", the first arm 104 of the garment hanger 100 may be folded along with the first shoulder portion 602 of the garment 650 while the garment 650 may still be able to be hung using the hook member 152. In circle "3", the second shoulder portion 604 of the garment 650 supported by the second arm 108 of the garment hanger 100 may be folded while the garment 650 may still be able to be hung using the hook member 152 in its extended position as shown.

In circle "4", the garment hanger 100 may be hung in folded state 600 using the hook member 152 with garment 650 still positioned on the garment hanger 100 and the hook member 152 remaining upright. The folded state 600 of the garment 650 may allow optimum utilization of the space (e.g., in a wardrobe, closet) by partially folding the garment 650 and hanging it using the hook member 152 in its extended position in a wrinkle free condition. In circle "5", the hook member 152 of the garment hanger 100 may be folded to transform the garment hanger 100 from folded state 600 to the most compact state 400 for packing the garment 650 so as to occupy minimal space in a portable carrier such as a suitcase while travelling, according to one embodiment.

According to one embodiment, folding of the hook member 152 may not be necessary to achieve the folded state 600. The folded state 600 and the most compact state 400 of the garment hanger 100 may exist independent of one another.

Figure 7:
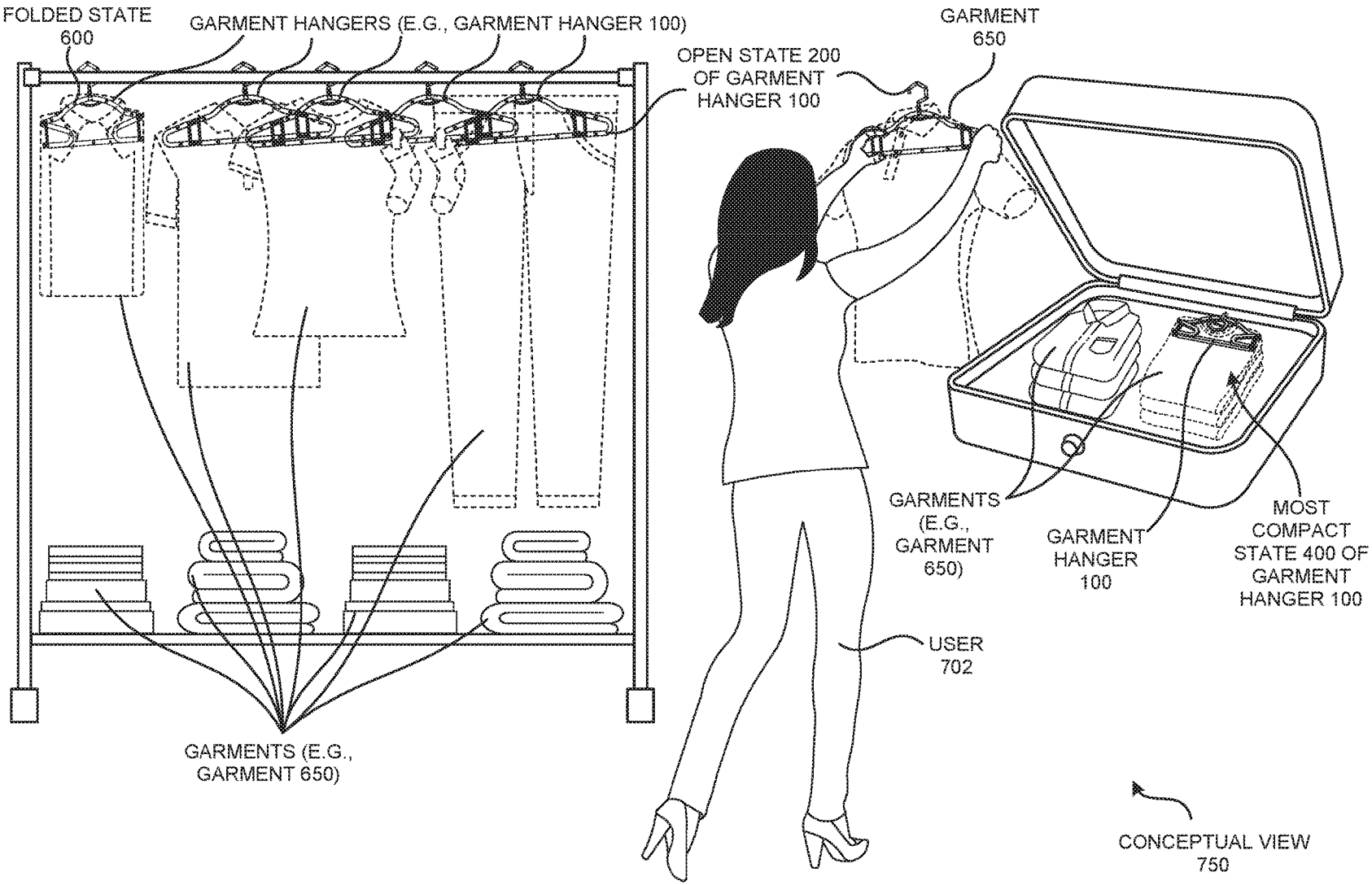
FIG. 7 is a conceptual view of the garment hanger illustrating a user folding and packing the free hanging apparel using the garment hanger of FIG. 1 without removing the apparel from the garment hanger, according to one embodiment.

FIG. 7 is a conceptual view 750 of the garment hanger 100 illustrating a user 702 folding and packing the free hanging apparel (e.g., garment 650) using the garment hanger 100 of FIG. 1 without removing the apparel (e.g., garment 650) from the garment hanger 100, according to one embodiment. While packing and/or unpacking the apparel (e.g., garment 650), the user 702 may not need to remove the apparel (e.g., garment 650) from the garment hanger 100 and the user 702 may directly pack the apparel (e.g., garment 650) while the apparel is still arranged on the garment hanger 100 in its most compact state 400. While unpacking, the user 702 may directly move the garment hanger 100 along with the apparel (e.g., garment 650) still arranged onto the garment hanger 100 from the most compact state 400 to hang the apparel (e.g., garment 650) in an open state 200 and/or a folded state 600.

An example embodiment will now be described. John Doe may be working in a management consulting firm based in Boise, Id. John's management consulting firm may be serving various businesses, government, and non-government organizations. John's management consulting firm may be helping their clients improve their performance and realize their important goals. As a consulting manager, John may have to work together with the firm's clients to get an insight of the client's needs to get a desired result. For this, John may have to travel to different cities. John's work profile may include staying and working with their clients to transform and realize their organizational goals into reality.

Many a times, John may have to travel for a few weeks in a month. In addition, John may have to attend numerous professional meets while on his official trips. John may need to carry a number of professional attire in a suitcase while travelling. John may be using a foldable garment frame to carry his professional attires in the suitcase. John may be organizing his professional attires in a folded form in addition to carrying the folded garment frame inside the suitcase. The folded garment frame inside the suitcase may have resulted in an inefficient utilisation of space. Further, the folded garment frame may make the suitcase heavy and cumbersome while travelling. Furthermore, John may frequently have to re-organize his professional attires from folded to free-hanging form to maintain the desired shape of the professional attire. The frequent transfer of the attire from folded to free-hanging forms onto the folded garment frame may have caused inconvenience to John in addition to causing wrinkles to the attire.

John may have bought a new set of multi-hinged tri-folding garment hanger (e.g., garment hanger 100) as described in various embodiments of FIGS. 1-7. John may have found these new set of garment hanger 100 very convenient, light weight, compact, and sturdy, to use. John may now be able to easily fold his professional attire (e.g., garment 650) using the garment hanger 100, as described in various embodiments of FIGS. 1-7, for packing. John may now be able to use the space in suitcase efficiently by making a compact fold (e.g., most compact state 400 of the garment hanger 100) of his attire (e.g., garment 650) without making his suitcase heavy and/or cumbersome. John may now be able to easily transform his folded attire (e.g., folded state 600 of garment 650) to free-hanging form just by retracting the hook member 152 to an extended condition to freely hang the professional attire (e.g., garment 650) in an open state 200 as described in various embodiments of FIGS. 1-7.

In addition, John may have found that using his new garment hanger 100 has reduced the number of wrinkles in his attire. John may now be able to maintain his professional attire (e.g., garment 650) inexpensively at low laundry cost and reduced dry-cleaning bill with much less effort, requiring minimal to no ironing of the attire. John may now have to spend minimal amount of time organising his professional attire (e.g., garment 650) while packing and/or unpacking while travelling, making him happy.

Although the present embodiments have been described with reference to specific example embodiments, it will be evident that various modifications and changes may be made to these embodiments without departing from the broader spirit and scope of the various embodiments.

A number of embodiments have been described. Nevertheless, it will be understood that various modifications may be made without departing from the spirit and scope of the claimed invention. In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

The invention claimed is:

1. A garment hanger comprising:

a central frame comprising a first arm toward a first end thereof and a second arm toward a second end thereof configured to support a first shoulder portion and a second shoulder portion of a garment respectively in an open state of the garment hanger, the central frame further comprising:

a top portion and a bottom portion separated in space; and a first double hinge joint on the top portion and a second double hinge joint on the bottom portion toward each of the first end and the second end around which correspondingly the first arm and the second arm are capable of folding back onto the central frame toward a center thereof to a folded state of the garment hanger, the top portion further comprising:

a first top element of the central frame and a second top element of the first arm each connected to the first double hinge joint toward the first end, the second top element being closer to the first end than the first top element in the open state; and a third top element of the central frame and a fourth top element of the second arm each connected to the first double hinge joint toward the second end, the fourth top element being closer to the second end than the third top element in the open state; and the bottom portion further comprising:

a first bottom element of the central frame and a second bottom element of the first arm each connected to the second double hinge joint toward the first end, the second bottom element being closer to the first end than the first bottom element in the open state; and a third bottom element of the central frame and a fourth bottom element of the second arm each connected to the second double hinge joint toward the second end, the fourth bottom element being closer to the second end than the third bottom element in the open state;

a first vertical member connecting the first top element to the first bottom element;

a second vertical member connecting the second top element to the second bottom element;

a third vertical member connecting the third top element to the third bottom element;

a fourth vertical member connecting the fourth top element to the fourth bottom element, each of the first vertical member, the second vertical member, the third vertical member and the fourth vertical member being parallel to a direction perpendicular to a direction connecting the first end to the second end; and a hook member pivotably attached to the top portion of the central frame along another direction perpendicular to the direction connecting the first end to the second end, the another direction comprising the center of the central frame thereon, and the hook member configured to enable hanging of the garment in the open state, wherein, in the open state, the first double hinge joint and the second double hinge joint toward the first end are further configured to be aligned approximately along a same direction as a length of the top portion and the bottom portion respectively of the central frame toward the first end, and the first double hinge joint and the second double hinge joint toward the second end are further configured to be aligned approximately along the same direction as the length of the top portion and the bottom portion respectively of the central frame toward the second end, and wherein, the first double hinge joint toward the first end is configured to swingably move such that the first double hinge joint toward the first end is perpendicular to both the length of the top portion of the central frame toward the first end and a length of the first arm folded back onto the central frame toward the center thereof in the folded state, the second double hinge joint toward the first end is configured to swingably move such that the second double hinge joint toward the first end is perpendicular to both the length of the bottom portion of the central frame toward the first end and the length of the first arm folded back onto the central frame toward the center thereof in the folded state, the first double hinge joint toward the second end is configured to swingably move such that the first double hinge joint toward the second end is perpendicular to both the length of the top portion of the central frame toward the second end and the length of the second arm folded back onto the central frame toward the center thereof in the folded state, the second double hinge joint toward the second end is configured to swingably move such that the second double hinge joint toward the second end is perpendicular to both the length of the bottom portion of the central frame toward the second end and the length of the second arm folded back onto the central frame toward the center thereof in the folded state, and the hook member is configured to retractably fold to be disposed across the separation in space between the top portion and the bottom portion of the central frame and in contact with the bottom portion thereof.

2. The garment hanger of claim 1, wherein at least one of: the first double hinge joint and the second double hinge joint toward the each of the first end and the second end is made of one of: a plastic material and a metallic material.

3. The garment hanger of claim 1, wherein at least some portion of the garment hanger is made of one of: aluminium, a polymer, wood and steel.

4. The garment hanger of claim 1, wherein the first arm is curved in shape.

5. The garment hanger of claim 1, wherein at least some portion of the garment hanger is made of sustainable material.

6. The garment hanger of claim 1, further comprising at least one groove on the central frame to enable hanging of a corresponding at least one strap of the garment on the at least one groove.

7. The garment hanger of claim 1, wherein the second arm is curved in shape.

8. The garment hanger of claim 1, wherein the first arm and the second arm are equidistant from the center of the central frame.

9. A garment hanger comprising:

a central frame comprising a first arm toward a first end thereof and a second arm toward a second end thereof configured to support a first shoulder portion and a second shoulder portion of a garment respectively in an open state of the garment hanger, the first arm and the second arm being equidistant from a center of the central frame, each of the first arm and the second arm being curved in shape, and the central frame further comprising:

a top portion and a bottom portion separated in space; and a first double hinge joint on the top portion and a second double hinge joint on the bottom portion toward each of the first end and the second end around which correspondingly the first arm and the second arm are capable of folding back onto the central frame toward the center thereof to a folded state of the garment hanger, the top portion further comprising:

a first top element of the central frame and a second top element of the first arm each connected to the first double hinge joint toward the first end, the second top element being closer to the first end than the first top element in the open state; and a third top element of the central frame and a fourth top element of the second arm each connected to the first double hinge joint toward the second end, the fourth top element being closer to the second end than the third top element in the open state; and the bottom portion further comprising:

a first bottom element of the central frame and a second bottom element of the first arm each connected to the second double hinge joint toward the first end, the second bottom element being closer to the first end than the first bottom element in the open state; and a third bottom element of the central frame and a fourth bottom element of the second arm each connected to the second double hinge joint toward the second end, the fourth bottom element being closer to the second end than the third bottom element in the open state;

a first vertical member connecting the first top element to the first bottom element;

a second vertical member connecting the second top element to the second bottom element;

a third vertical member connecting the third top element to the third bottom element;

a fourth vertical member connecting the fourth top element to the fourth bottom element, each of the first vertical member, the second vertical member, the third vertical member and the fourth vertical member being parallel to a direction perpendicular to a direction connecting the first end to the second end; and a hook member pivotably attached to the top portion of the central frame along another direction perpendicular to the direction connecting the first end to the second end, the another direction comprising the center of the central frame thereon, and the hook member configured to enable hanging of the garment in the open state, wherein, in the open state, the first double hinge joint and the second double hinge joint toward the first end are further configured to be aligned approximately along a same direction as a length of the top portion and the bottom portion respectively of the central frame toward the first end, and the first double hinge joint and the second double hinge joint toward the second end are further configured to be aligned approximately along the same direction as the length of the top portion and the bottom portion respectively of the central frame toward the second end, and wherein, the first double hinge joint toward the first end is configured to swingably move such that the first double hinge joint toward the first end is perpendicular to both the length of the top portion of the central frame toward the first end and a length of the first arm folded back onto the central frame toward the center thereof in the folded state, the second double hinge joint toward the first end is configured to swingably move such that the second double hinge joint toward the first end is perpendicular to both the length of the bottom portion of the central frame toward the first end and the length of the first arm folded back onto the central frame toward the center thereof in the folded state, the first double hinge joint toward the second end is configured to swingably move such that the first double hinge joint toward the second end is perpendicular to both the length of the top portion of the central frame toward the second end and the length of the second arm folded back onto the central frame toward the center thereof in the folded state, the second double hinge joint toward the second end is configured to swingably move such that the second double hinge joint toward the second end is perpendicular to both the length of the bottom portion of the central frame toward the second end and the length of the second arm folded back onto the central frame toward the center thereof in the folded state, and the hook member is configured to retractably fold to be disposed across the separation in space between the top portion and the bottom portion of the central frame and in contact with the bottom portion thereof.

10. The garment hanger of claim 9, wherein the first double hinge joint toward the each of the first end and the second end is made of one of: a plastic material and a metallic material.

11. The garment hanger of claim 9, wherein at least some portion of the garment hanger is made of one of: aluminium, a polymer, wood and steel.

12. The garment hanger of claim 9, wherein the second double hinge joint toward the each of the first end and the second end is made of one of: a plastic material and a metallic material.

13. The garment hanger of claim 9, wherein at least some portion of the garment hanger is made of sustainable material.

14. The garment hanger of claim 9, further comprising at least one groove on the central frame to enable hanging of a corresponding at least one strap of the garment on the at least one groove.

15. A garment hanger comprising:

a central frame comprising a first arm toward a first end thereof and a second arm toward a second end thereof configured to support a first shoulder portion and a second shoulder portion of a garment respectively in an open state of the garment hanger, the first arm and the second arm being equidistant from a center of the central frame, the central frame further comprising:

a top portion and a bottom portion separated in space; and a first double hinge joint on the top portion and a second double hinge joint on the bottom portion toward each of the first end and the second end around which correspondingly the first arm and the second arm are capable of folding back onto the central frame toward the center thereof to a folded state of the garment hanger, the top portion further comprising:

a first top element of the central frame and a second top element of the first arm each connected to the first double hinge joint toward the first end, the second top element being closer to the first end than the first top element in the open state; and a third top element of the central frame and a fourth top element of the second arm each connected to the first double hinge joint toward the second end, the fourth top element being closer to the second end than the third top element in the open state; and the bottom portion further comprising:

a first bottom element of the central frame and a second bottom element of the first arm each connected to the second double hinge joint toward the first end, the second bottom element being closer to the first end than the first bottom element in the open state; and a third bottom element of the central frame and a fourth bottom element of the second arm each connected to the second double hinge joint toward the second end, the fourth bottom element being closer to the second end than the third bottom element in the open state;

a first vertical member connecting the first top element to the first bottom element;

a second vertical member connecting the second top element to the second bottom element;

a third vertical member connecting the third top element to the third bottom element;

a fourth vertical member connecting the fourth top element to the fourth bottom element, each of the first vertical member, the second vertical member, the third vertical member and the fourth vertical member being parallel to a direction perpendicular to a direction connecting the first end to the second end; and a hook member pivotably attached to the top portion of the central frame along another direction perpendicular to the direction connecting the first end to the second end, the another direction comprising the center of the central frame thereon, and the hook member configured to enable hanging of the garment in the open state, wherein, in the open state, the first double hinge joint and the second double hinge joint toward the first end are further configured to be aligned approximately along a same direction as a length of the top portion and the bottom portion respectively of the central frame toward the first end, and the first double hinge joint and the second double hinge joint toward the second end are further configured to be aligned approximately along the same direction as the length of the top portion and the bottom portion respectively of the central frame toward the second end, and wherein, the first double hinge joint toward the first end is configured to swingably move such that the first double hinge joint toward the first end is perpendicular to both the length of the top portion of the central frame toward the first end and a length of the first arm folded back onto the central frame toward the center thereof in the folded state, the second double hinge joint toward the first end is configured to swingably move such that the second double hinge joint toward the first end is perpendicular to both the length of the bottom portion of the central frame toward the first end and the length of the first arm folded back onto the central frame toward the center thereof in the folded state, the first double hinge joint toward the second end is configured to swingably move such that the first double hinge joint toward the second end is perpendicular to both the length of the top portion of the central frame toward the second end and the length of the second arm folded back onto the central frame toward the center thereof in the folded state, the second double hinge joint toward the second end is configured to swingably move such that the second double hinge joint toward the second end is perpendicular to both the length of the bottom portion of the central frame toward the second end and the length of the second arm folded back onto the central frame toward the center thereof in the folded state, and the hook member is configured to retractably fold to be disposed across the separation in space between the top portion and the bottom portion of the central frame and in contact with the bottom portion thereof.

16. The garment hanger of claim 15, wherein at least one of: the first double hinge joint and the second double hinge joint toward the each of the first end and the second end is made of one of: a plastic material and a metallic material.

17. The garment hanger of claim 15, wherein at least some portion of the garment hanger is made of one of: aluminium, a polymer, wood and steel.

18. The garment hanger of claim 15, wherein at least some portion of the garment hanger is made of sustainable material.

19. The garment hanger of claim 15, further comprising at least one groove on the central frame to enable hanging of a corresponding at least one strap of the garment on the at least one groove.

20. The garment hanger of claim 15, wherein the first arm and the second arm are both curved in shape.

* * * * *